United States Patent [19]

Rittinger et al.

[11] Patent Number: 4,693,057

[45] Date of Patent: Sep. 15, 1987

[54] APPARATUS FOR ORDERING AND FEEDING A SMALL ITEM LIKE A TABLET, CAPSULE, PILL OR DRAGEE IN A PACKAGING MACHINE

[75] Inventors: Herbert Rittinger; Detlev H. Gertitschke, both of Laupheim; Karlheinz Rapp, Mittelbiberach; Bernd Eberle, Laupheim, all of Fed. Rep. of Germany

[73] Assignee: Josef Uhlmann Maschinenfabrik GmbH & Co. KG, Laupheim, Fed. Rep. of Germany

[21] Appl. No.: 934,251

[22] Filed: Nov. 24, 1986

[30] Foreign Application Priority Data

Nov. 26, 1985 [DE] Fed. Rep. of Germany ..... 3541672

[51] Int. Cl.[4] ..... B65B 35/30; B65B 5/08

[52] U.S. Cl. ..... 53/539; 53/247

[58] Field of Search ..... 53/158, 539, 543, 246, 53/247, 251, 503, 504

[56] References Cited

U.S. PATENT DOCUMENTS

| | | | |
|---|---|---|---|
| 3,431,702 | 3/1969 | Spaulding | 53/539 X |
| 3,545,164 | 12/1970 | Middleton | 53/539 X |
| 3,789,575 | 2/1974 | Bross | 53/539 X |
| 4,026,091 | 5/1977 | Pearson | 53/247 X |
| 4,322,930 | 4/1982 | Braverman | 53/543 X |
| 4,403,462 | 9/1983 | Halbich | 53/158 X |
| 4,525,985 | 7/1985 | Sammens | 53/539 X |

FOREIGN PATENT DOCUMENTS 2262951 6/1974 Fed. Rep. of Germany .

*Primary Examiner*—Horace M. Culver

*Attorney, Agent, or Firm*—Karl F. Ross; Herbert Dubno

[57] ABSTRACT

The apparatus for feeding and depositing small items, such as a tablet, capsule, pill or the like, in a deep drawn foil strip comprises a feed slider and a distributing slider. Above the foil strip the two sliders are positioned over each other. The upper slider movable transverse to the foil strip direction is the feed slider with a plurality of openings formed to receive and pass small items and positioned in the same pattern as the cups. The lower slider movable along the foil strip direction is the distributing slider with a plurality of holes allowing the passage of the small items from the openings into the cups. The sliders are slidable between a delivering position in which the openings cover the holes and the cups and a closed position in which the distributing slider secures the bottoms of the openings against a passage of the small items. The feed slider forms the base of a loading box fillable with the small items in no particular order provided adjacent the foil stirp in the motion direction and is movable back and forth from the delivery position with all its openings until in the loading box. The loading box is closed in the direction of the foil strip by a skimmer strip for the small items. Below the feed slider a lower base is positioned which secures the openings from below against the falling through of the small items and forms the sliding path for the samll items in the sliding motion. The feed slider is moved in rapid alternation with its openings inside of the loading box for uniform filling of the openings with small items.

14 Claims, 9 Drawing Figures

FIG. 8
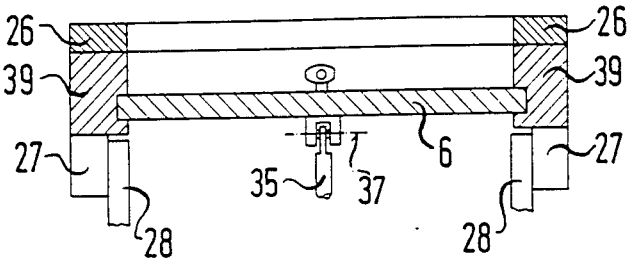
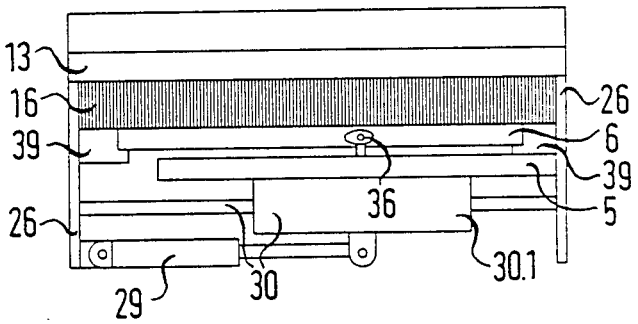
FIG. 9

APPARATUS FOR ORDERING AND FEEDING A SMALL ITEM LIKE A TABLET, CAPSULE, PILL OR DRAGEE IN A PACKAGING MACHINE

FIELD OF THE INVENTION

Our present invention relates to an apparatus for ordering and feeding a small item to be packaged in a packaging machine, and, more particularly, an apparatus for this purpose to be used in a packaging machine for a pharmaceutical products including a tablet, a capsule, a pill, a dragee or the like.

BACKGROUND OF THE INVENTION

An apparatus for feeding and depositing a small item to be packaged like a tablet, capsule, pill, dragee or the like in a packaging machine into a plurality of upwardly open cups or pockets in an advantageously deep-drawn foil strip, can comprise a feed slider and a distributing slider substantially parallel to the foil strip positioned above the foil strip over one above the other.

The upper one of the sliders movable transverse to the feed direction of the foil strip is the feed slider and is provided with a plurality of openings each dimensioned for receiving and passing only one of the small items and arranged in a pattern like the cups.

The lower slider, movable in the feed direction of the foil strip, is the distributing slider and is provided with a plurality of holes for individual passage of the small items from the openings into the cups. The sliders are slidable into a delivery position in which the openings coincide with the holes and with the cups and at least one of the sliders into a closed position in which the distributing slider secures the openings in the feed slider underneath against passage of small items.

In a known feeding and depositing apparatus taught in German Open Patent Application No. 22 62 951 the slider usually moves along the foil strip under outlet mouths of troughs feeding the small items in regular rows. The small items fall into the openings of the feed slider passing through the outlet mouths in succession.

The feed slider is pushed against the distributing slider transverse to the foil feed direction into the closed position so that the distributing slider closes the bottoms of the openings to the foil strip.

However the holes in the distributing strip coincide with the cups in the foil strip. When all openings of the feed slider are each filled with a small item after running both sliders under the trough mouths, the feed slider is pushed from the closed position transverse to the foil strip direction into the delivery position so that the small items fall from the openings through the holes downward into the cups.

These holes are slots open at one end which extend in the foil strip direction over almost the entire length of the distributing slider so that the distributing slider has a substantially comblike shape.

The openings of the feed slider empty into the cups on being kept in their delivery position. Then both sliders jointly are pulled back in the foil strip direction under the outlet mouths of the troughs. Thus the openings of the feed slider are displaced transversly with respect to the outlet mouths of the trough so that the foremost small items in the trough sliding through it are put on the feed slider and the small item feed stops until the feed slider in the original initial position slides transversely into the closed position so that the openings turn out under the bottoms of the outlet mouths but nevertheless are closed by the distributing slider.

This known feeding and depositing apparatus has the disadvantage that the feed slider motion must be performed in two directions perpendicular to each other which makes the structure of its guide and drive expensive and the adjustment of the changed package format complicated.

It is also disadvantageous that the small items require an alignment and arrangement on filling the feed slider to principally be able to reach the troughs so that the openings can be filled with the small items in succesion from the trough which takes much time.

It is also a disadvantage that the filling of the feed slider occurs with the small items over the foil strip thus product dust and/or broken pieces originating from the small items fall not only into the cups but also on the top side of the foil strip between and outside of the cups which in later sealing of the foil strip with a covering foil acting to close the filled cups can lead to inclusion of contanments in the product and thus to waste of the packages.

OBJECTS OF THE INVENTION

It is an object of our invention to provide an improved apparatus for feeding and depositing a small item to be packaged, such as a tablet, capsule, pill, dragee or the like, in a packaging machine into a plurality of upwardly open cups in an advantageously deep drawn foil strip which will obviate prior art drawbacks.

It is also an object of our invention to provide an improved apparatus for feeding and depositing a small item to be packaged, such as a tablet, capsule, pill or the like, in a packaging machine into a plurality of upwardly open cups in an advantageously deep drawn foil strip in which the feeding by the feed slider is as simple and fast as possible.

It is another object of our invention to provide an improved apparatus for feeding and depositing a small item to be packaged such as a tablet, capsule, pill or the like, in a packaging machine into a plurality of upwardly open cups in an advantageously deep drawn foil strip in which the product dust or broken pieces can not reach the foil strip or the cups in the foil strip.

It is yet another object of our invention to provide an improved apparatus for feeding and depositing a small item to be packaged, such as a tablet, capsule, pill or the like, in a packaging machine into a plurality of upwardly open cups in an advantageously deep drawn foil strip in which the structure of the apparatus is so simple that operations which occur together with cleaning and format changing in product and/or packaging changes can be performed without expense and noteworthy stopping time.

SUMMARY OF THE INVENTION

These objects and others which will become more readily apparent hereinafter are attained in accordance with our invention in an apparatus for feeding and depositing a small item to be packaged like a tablet, capsule, pill, dragee or the like in a packaging machine into a plurality of upwardly open cups in a deep drawn foil strip comprises a feed slider and a distributing slider substantially parallel to the foil strip positioned above the foil strip over each other.

The upper one of the sliders movable transverse to the feed direction of the foil strip is the feed slider and is provided with a plurality of openings each dimensioned for receiving and passing only one small item and arranged in a pattern like the cups.

The lower slider movable along the feed direction of the foil strip is the distributing slider and is provided with a plurality of holes for the passage of the small items from the openings into the cups.

The sliders are slidable into a delivery position in which the openings coincide with the holes and with the cups and at least one of the sliders is slidable into a closed position in which the distributing slider secures the openings in the feed slider underneath against passage of small items.

According to our invention the distributing slider is movable into the closed position and the holes are interrupted in the sliding direction of the distributing slider by a plurality of cross members which are oriented longitudinally in the sliding direction of the feed slider and in the closed position of the distributing slider are under the openings of the feed slider movable into the delivery position, the feed slider forming the bottom of a loading box filled with the small items in no particular order (i.e. in an unordered state) provided laterally adjacent the foil strip in the motion direction of the foil strip and being movable back from and into a delivery position with all of the openings into the loading box.

The loading box is closed in the direction of the foil strip on the top side of the feed slider for the small items by a skimmer strip and is provided with a lower base under the feed slider which extends under the loading box to the distributing slider and secures the openings of the feed slider from the distributing slider from below against the passage of the small items as well as aligns with the cross members of the distributing slider and forms a sliding path for the small pieces with the openings of the feed slider during motion of the feed slider.

The small pieces in the openings on the lower base are substantially completely shut off on the upper side of the feed slider and the feed slider is movable in a quickly alternating fashion, namely in a vibrating, shaking or like action, in position with the openings inside the loading box for uniform filling of the openings with the small items.

The loading box in comparison to the feed motion is of such a size that in the sliding motion none of the openings reach a position under the skimmer strip or a rear wall opposing the skimmer strip.

As a result with short alternating strokes the small items lying in the loading case on the feed slider in no particular order in a very short time interval are brought to all the openings, the small items undergoing an orientation and arrangement also corresponding to their own form and the arrangement of the openings fitting their form as is required (i.e. the tablets are ordered).

Practice has shown that the filling of all openings of the feed slider occurs very quickly and reliably when the amplitude and speed of the short stroke alternating motions and the excess supply of small items in the loading case above the number required for the complete slider filling is selected to correspond to the nature of the small items and when the possibility exists to adjust independently of each other the frequency of the slider motion.

Since with this slider motion the small items during the filling process can not be forced with no possibility of evasion against a shoulder edge the small items are present and are not broken up or destroyed in some other way. Also there is an optimum short dwell time for the individual small items in the loading box which effects the products significantly. The feed slider with filled openings is pushed into the delivery position, the excess small items being retained on the feed slider by the skimmer strip in the loading box, while the small items in the openings on account of their substantially complete enclosure in the feed slider pass the skimmer strip without problems and also can not be forced from their openings by small items retained in the loading case by the skimmer strip.

Likewise product dust and broken pieces occuring on filling are retained by the skimmer strip on the feed slider. Thus the dust reaches the openings, falls onto the lower base where it is easily removed, however it can not contaminate the foil strip.

On the path between the loading box and the delivery position the small items in the openings of the feed slider slide over the foil strip to the lower base then to the cross members of the distributing slider into the closed position so that it requires finally only the motion of the distributing slider from the closed position into the delivery position to empty the openings into the cups.

The distributing slider moves thus only in a single direction to and fro, namely transverse to the feed slider, the distributing slider moving along the foil strip direction. That allows construction of a simple guide and drive for the sliders which can be built and/or exchanged quickly and easily when product and/or format changes are desired.

Advantageously the skimmer strip is a brush strip with a plurality of downwardly directed elastically flexible bristles reaching to the upper side of the feed slider. A rear retaining strip for the small items extending over the width of the loading box and positioned approximately centrally in the loading box can be provided which defines a gap with the upper side of the feed slider of at least the height of the small items on the upper side of the feed slider.

The rear retaining strip is advantageously a brush strip with a plurality of elastic flexible bristles, the bristles reaching downwardly to the top of the gap. This retaining strip acts so that on pulling back the feed slider from the delivery position a part of the small items present in the loading box on the feed slider is already retained in the front part of the loading box, the small items spread out quicker over the entire surface of the feed slider into the loading box and all slider openings can be filled when the travelling back feed slider is moved again in short alternating strokes for the purpose of a fresh feeding of its openings.

To guarantee a reliable filling of the openings, the filling state in the loading box should be controlled and by a corresponding subsequent filling should be maintained at an optimum nominal value.

According to the invention in the front portion of the loading box adjacent the skimmer strip a sensor controlling the filling state of the small items can be provided in the loading box and the filling of the loading box with the small items can be controllable with a signal from the sensor.

The lower base advantageously has a plurality of perforations not preventing the sliding of the small items on the lower base and forming a cover for a suction housing connected to a vacuum source and between the underside of the feed slider and the upper side of the lower base a free space smaller than the height of the small items in the openings exists. Inside of this free space the product dust and/or broken pieces can reach the suction housing through the perforation openings under vacuum and from there can be removed. Understandably the perforation openings have a cross section and a free spacing between the lower base and the feed slider which is so small that the small items can not arrive between the lower base and the feed slider and in the perforation openings.

Advantageously the feed slider and the distributing slider are guided in a frame which is supported to the pivotable to and from the foil strip and at least partially supports a slider drive and the loading box and the lower base with the suction housing. In the swung up state of the frame both sliders and all other named components are accessible from below and the foil strip accessible from above which makes cleaning and maintenance easy.

The sliders differ only in the arrangement and structure of the openings and/or holes for the different products and/or formats. Product and format changes can be performed particularly easily when in another embodiment of our invention the sliders are easily interchangable in the frame, are releasably coupled with the slider drive and are withdrawable from a plurality of guides in a guiding direction into an uncoupled state. It is also advantageous when the lower base is attached detachably with the suction housing and the suction housing and the lower base are attached detachably with the frame so that they are detachable easily with the frame swung up and the suction housing can be opened for cleaning.

An easy change of the format width can be attained when the walls of the loading box bounding laterally the loading box between the skimmer strip and the rear wall are guidable slidably transverse to the rear wall and the rear wall and the walls of the loading box are adjustable in height to fit the thickness of the feed slider. Suitably to facilitate cleaning and exchange the skimmer strip on the frame and the rear retaining strip on the lateral walls of the loading box are kept easily exchangable.

The frame can be supported and held on the base member, which is movable parallel to the base member in the feed direction of the foil strip and is held fixed in position, so that the feed slider and the distributing slider are adjustable by a simple sliding of the base item with their openings and/or holes exactly over the cups of the foil strips.

Finally advantageously the foil strip runs over a lifting table provided under the distributing strip which raises and lowers the foil strip to and from the distributing slider by a control process depending on the sliding motion, so that the possiblity exists that the foil strip is pressed with the aid of the lifting table from below against the distributing slider when both sliders are found in the delivery position and a short drop path is desired for the small items in the cups of the foil.

BRIEF DESCRIPTION OF THE DRAWING

The above and other objects, features and advantages of our invention will become more readily apparent from the following description, reference being made to the accompanying highly diagrammatic drawing in which:

FIG. 8 is a cross section view of the apparatus of FIG. 7 taken along the section line VIII—VIII of FIG. 7; and FIG. 9 is view of the apparatus according to FIG. 7 as seen in the direction of the arrow IX.

SPECIFIC DESCRIPTION

Figure 1:
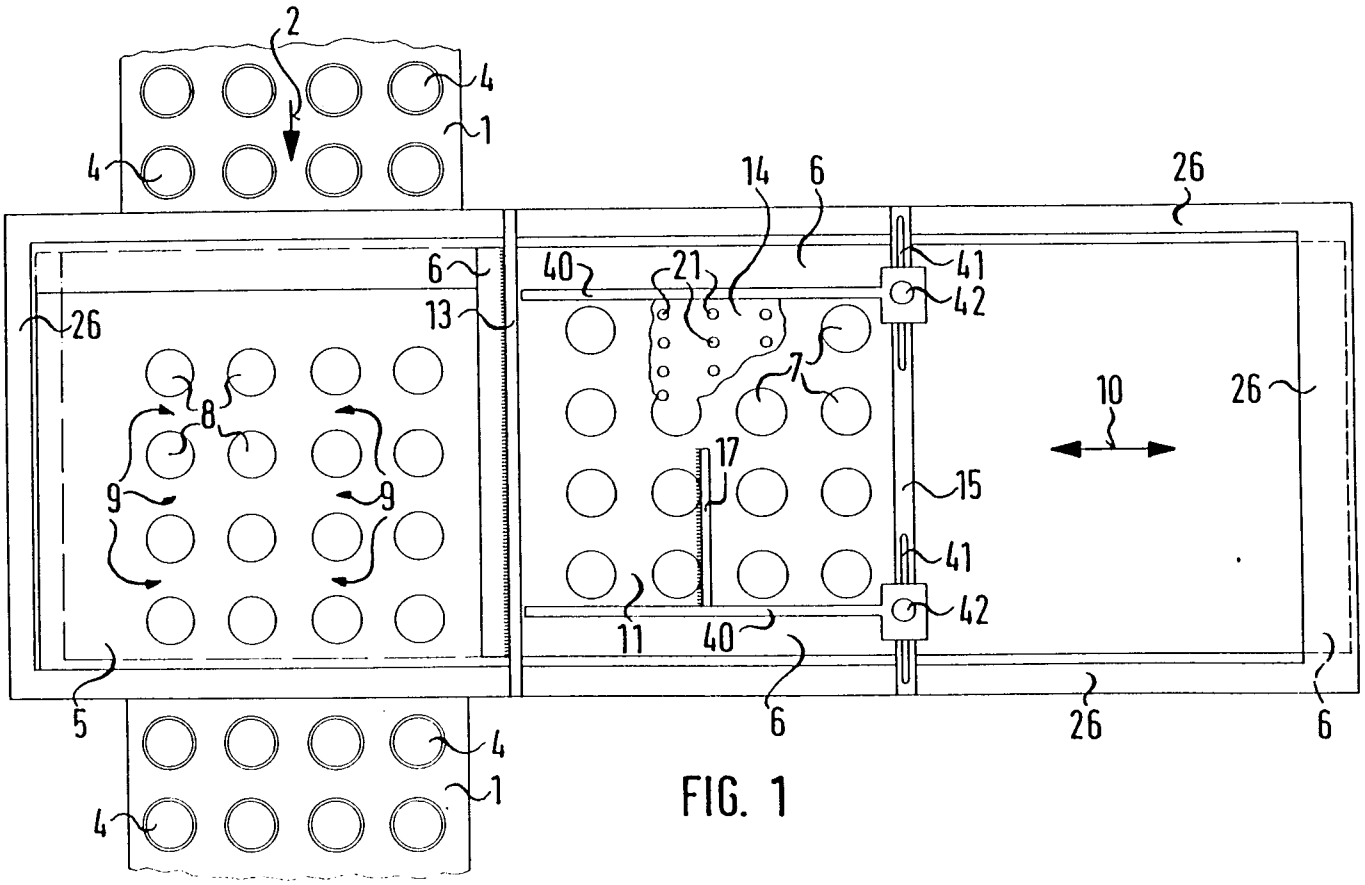
FIG. 1 is a top plan view of an apparatus for feeding and depositing small items in a packaging machine according to our invention in which the feed slider is in the filling position.

The foil strip 1 is fed in the direction of the arrow 2. Cups or pookets 4 are provided for reoeiving tablet shaped small items 3.

These cups 4 can be formed by deep drawing in a known manner not described here in detail at a cup forming station, the foil strip comprising a deep drawn material, e.g. metal or plastic foil.

The foil strip has its cups 4 filled with the small items 3 and sealed with a covering foil not shown in the drawing in a way which is not described further, whereby the small items 3 are enclosed in the cups 4.

Subseqeuntly pieces from the filled and sealed foil strip 1 of the desired size and cup number can be punched out which is likewise known and needs no description. The apparatus shown in the drawing thus simply has the purpose of quickly and reliably bringing and putting the small items 3 into the cups 4 and of course so that damage to the small items 3 is avoided as much as possible.

The apparatus has two substantially planar parallel sliders 5,6 positioned one on top of the other with the upwardly open cups. The upper slider 6 is movable substantially transverse to the foil strip 1(arrow 2). It acts as a feed slider and is provided with openings 7 arranged in the same pattern as the cups 4 which are formed and fit the small items 3 so that it takes one of the small items 3 which travels with the sliding motion reliably and may fall through when released downwardly.

Besides the openings 7 can be formed in a predetermined way so that the apparatus is appropriately insensitive to the shape of the small items 3.

The lower distributing slider 5 is movable to and fro along the foil strip 1 in the direction shown by the arrow 2. It acts as a distributing slider and is provided with holes 8. These holes 8 are usually so formed that the apparatus remains insensitive to the shape of the small items 3.

Figure 4:
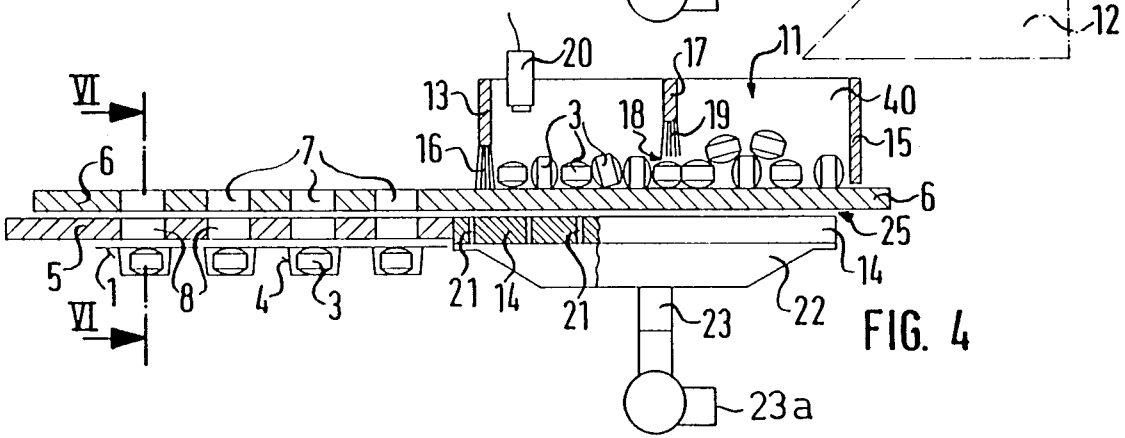
FIG. 4 is a longitudinal cross sectional view through the apparatus according to FIG. 2 in the embodiment of FIG. 3 with distributing slider.
Figure 5:
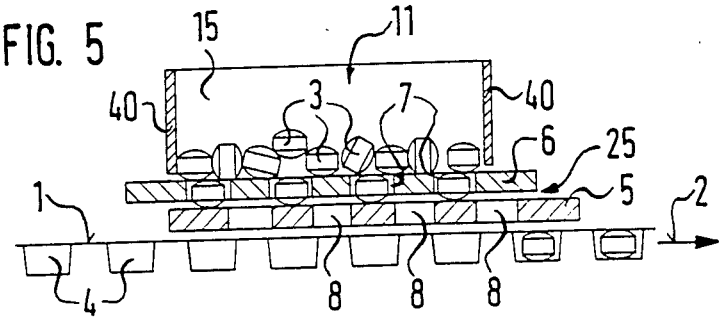
FIG. 5 is cross sectional view taken along the section line V—V of FIG. 3.
Figure 6:
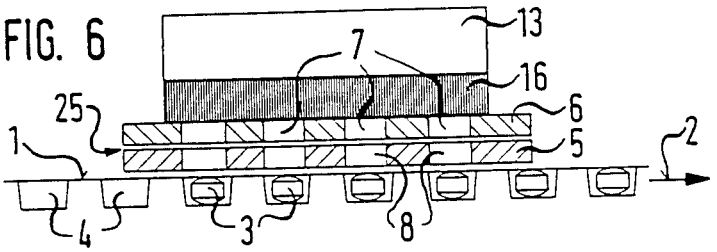
FIG. 6 is a cross sectional view taken along the section line VI—VI of FIG. 4.

Both sliders 5,6 are movable into a delivering postion shown in FIGS. 4 and 6, in which the the positions of the openings 7 substantially coincide with those of the holes 8 and cups 4.

The distributing slider 5 is movable from the delivering position into the closed position as is apparent from FIGS. 1 to 3 and 5 in which it closes the openings 7 in the feed slider 6 to prevent downward falling of the small items 3. Its holes 8 are spaced from each other in their own sliding direction which coincides with the foil strip direction (arrow 2) by cross members 9, which are oriented longitudinally in the feed direction (arrow 10) of the feed slider 6 and which in the closed position of the distributing slider 5 lie under the openings 7 of the feed slider 6 movable into the delivering position and close them.

The feed slider 6 forms the bottom of a loading box 11 which is filled irregularly in this embodiment by an oscillating trough 12 with the small items 3.

Figure 2:
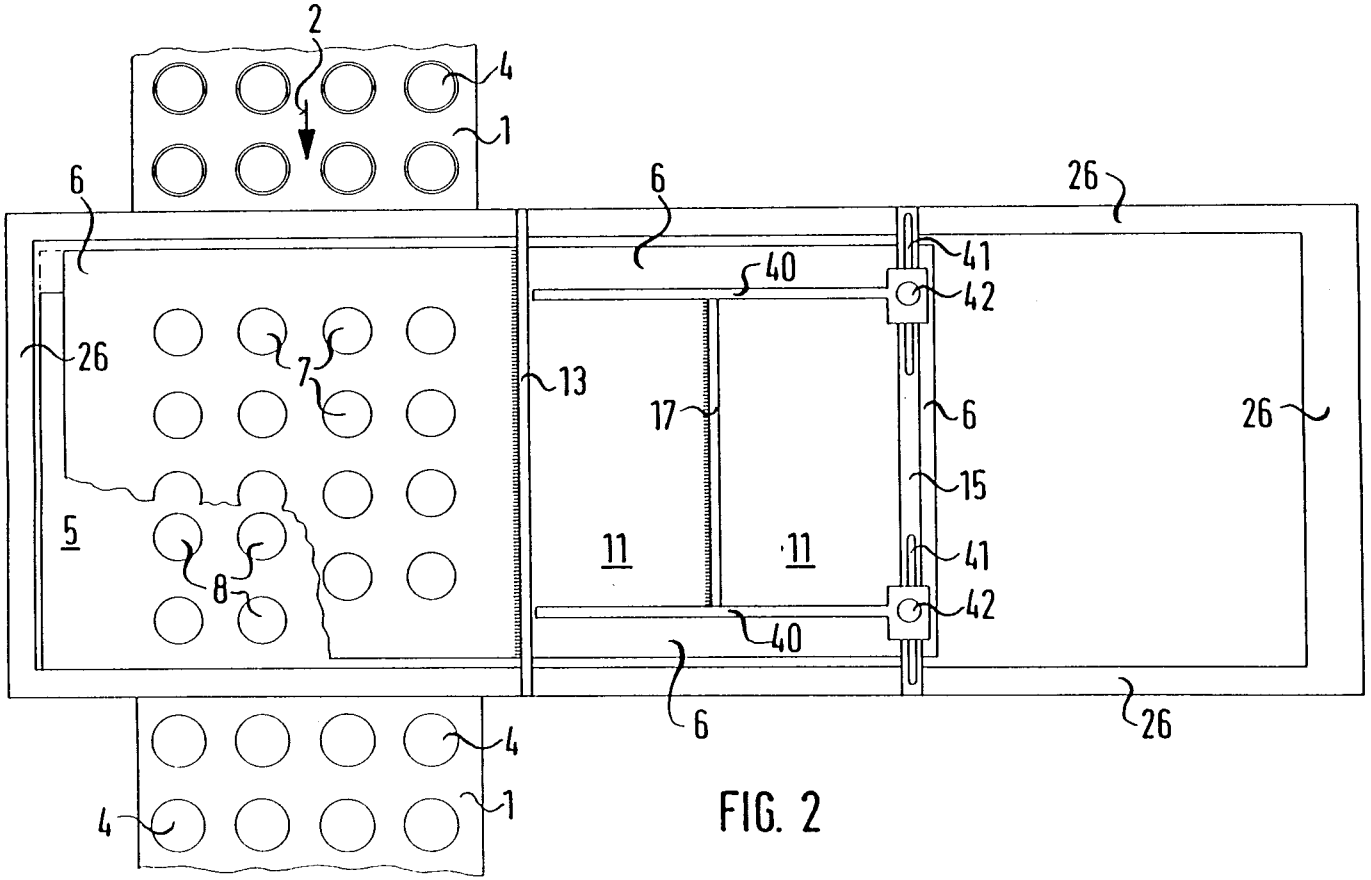
FIG. 2 is a top plan view of the apparatus of FIG. 1 in which the feed slider is in the dumping position and the distriubting slider is in the closed position.
Figure 3:
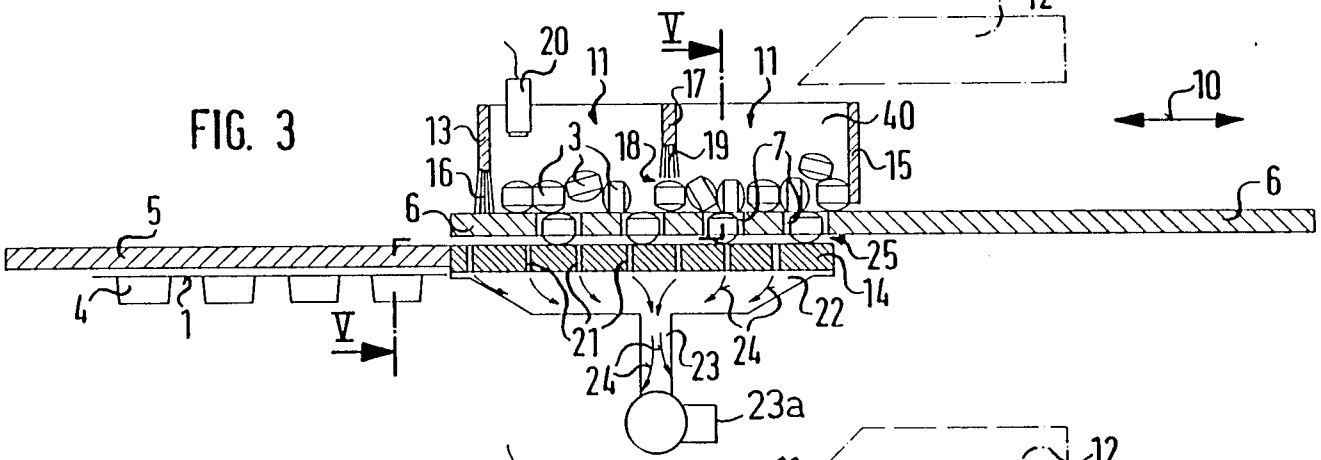
FIG. 3 is a longitudinal cross sectional view through the apparatus according to FIG. 1 with additional small items to be packaged shown.

The feed slider 6 can be moved back from the delivering position (FIGS. 2, 4) with all of its openings until it is in the loading box 11 (FIGS. 1, 3). In the vicinity of the feed slider 6 which lies in the portion of the feed slider 6 under the loading box 11 understandably the feed slider 6 has none of its openings 7. The thickness of the feed slider 6 is almost equal in height to the small items 3 in its openings 7 so that it is sealed substantially flush with the top side of the feed slider 6 as is particularly apparent from FIGS. 3 and 5. The small items 3 in the openings 7 when the feed slider 6 moves can be forced by other small items on the upper surface of the slider 6 from their openings 7 and particularly when in the feed slider pass a skimmer strip 13.

When the feed slider 6 moves into the delivery position it closes the loading box 11 with its top surface. Also small items 3 still lying on the top side of the feed slider 6 are retained in the loading box 11.

Below the feed slider 6 a lower base 14 is found which is connected to the distributing slider 5 in the motion direction (arrow 10) and extends under the loading box 11. This lower base 14 secures the openings 7 of the feed slider also in the drawn back or closed position so that the small items 3 do not fall through and aligns the top side with the distributing slider 5, particularly its cross members 9 so that the lower base like these cross members 9 form a smooth path for the small items 3 when the feed slider 6 is moved from the filling position (FIGS. 1, 3) into the delivery position (FIGS. 2, 4).

Thus the openings 7 of the feed slider 6 are filled quickly and reliably with small items 3 in their position inside of the loading box 11 (FIGS. 1, 3), the feed slider 6 being guided in short reversing for example sinusoidal oscillating motions or shaking motions none of the openings 7 reaching under the skimmer strip 13 or the rear wall 15 of the loading box 11 in the rear of the apparatus opposing it.

In this way during the sliding motion small items 3 not completely reaching the openings 7, forced from the openings 7 to the skimmer strip 13 or to the rear wall 15 or damaged in other ways are avoided.

The skimmer strip 13 is a brush directed downwardly in this embodiment until the elastic flexible bristles 16 contact the upper side of the feed slider 6. The skimmer strip 13 can be a rotatably driven brush roller.

To prevent all small items 3 remaining in the loading box 11 from remaining completely in the rear portion of the loading box and collecting in front of the rear wall 15 when the feed slider 6 is pulled back from the delivery position (FIGS. 2, 4) into the filling position (FIGS. 1, 3) a rear retaining strip 17 for the small items 3 is provided over the entire width of the loading box 11 parallel to the skimmer strip 13 approximately in the middle of the loading box 11. It forms a gap 18 with the upper side of the feed slider 6 of at least the height of the small items 3 on the surface of the feed slider 6 and holds back a portion of these small items during a back motion of the slider 6 so that these held back small items are found at the end of the rearward motion and are distributed over the entire surface of the loading box 11 quickly and uniformly on subsequent vibration and shaking. Also the rear retaining strip 17 is a brush strip with elastic flexible bristles 19 which reach downwards to the top of the gap 18. To perform the filling of the openings 7 with small items 3 in an optimum reliable way in the front part of the loading box 11 near the skimmer strip 13 a sensor 20 for control of the filling state of the small items 3 is provided in the loading box 11. The filling of the loading box 11 is controlled from the vibrating trough 12 depending on the sensor signal so that a goodly number of small items 3 are available continuously for the rapid and reliable filling of the openings 7.

To carry away the product dust and broken pieces produced on filling the openings 7 with the small items and to prevent these dust and broken pieces from reaching the foil strip 1 principally or the cups 4, the dust and/or broken pieces are held back by the skimmer strip 13 in the loading box 11 and fall through the openings 7 onto the lower base 14 before the limit of the current delivery position has been reached. The dust and broken pieces are sucked from the lower base 14. Moreover the lower base 14 is provided with perforations 21 which are small in comparison to the size of the small items 3 and which do not prevent their sliding on the lower base 14 (a portion of the feed slider 6 being cut away to show them in FIG. 1) and this perforated lower base 14 forms the cover of a suction housing 22 which is connected with pipe 23 to a vacuum source **23*a* so that a suction air stream indicated by the arrow 24** takes away the dust and broken pieces.

The perforations 21 are located near the lower base 14 in front of the skimmer strip 13 as seen from the distributing slider 5 so that the suction effect still exists between the skimmer strip 13 and the distributing slider 5. Between the lower side of the feed slider 6 and the upper side of the lower base 14 a small free space 25 exists which, since the lower base 14 aligns with the distributing slider 5, correspondingly is present also between the latter and the feed slider 6 as shown in FIGS. 3 to 6. In the gap between the lower base 14 and the feed slider 6 formed by this free space 25 the dust and broken pieces falling through the openings 7 can reach into the perforations 21 of the lower base 14 and through these into the suction housing 22.

Figure 7:
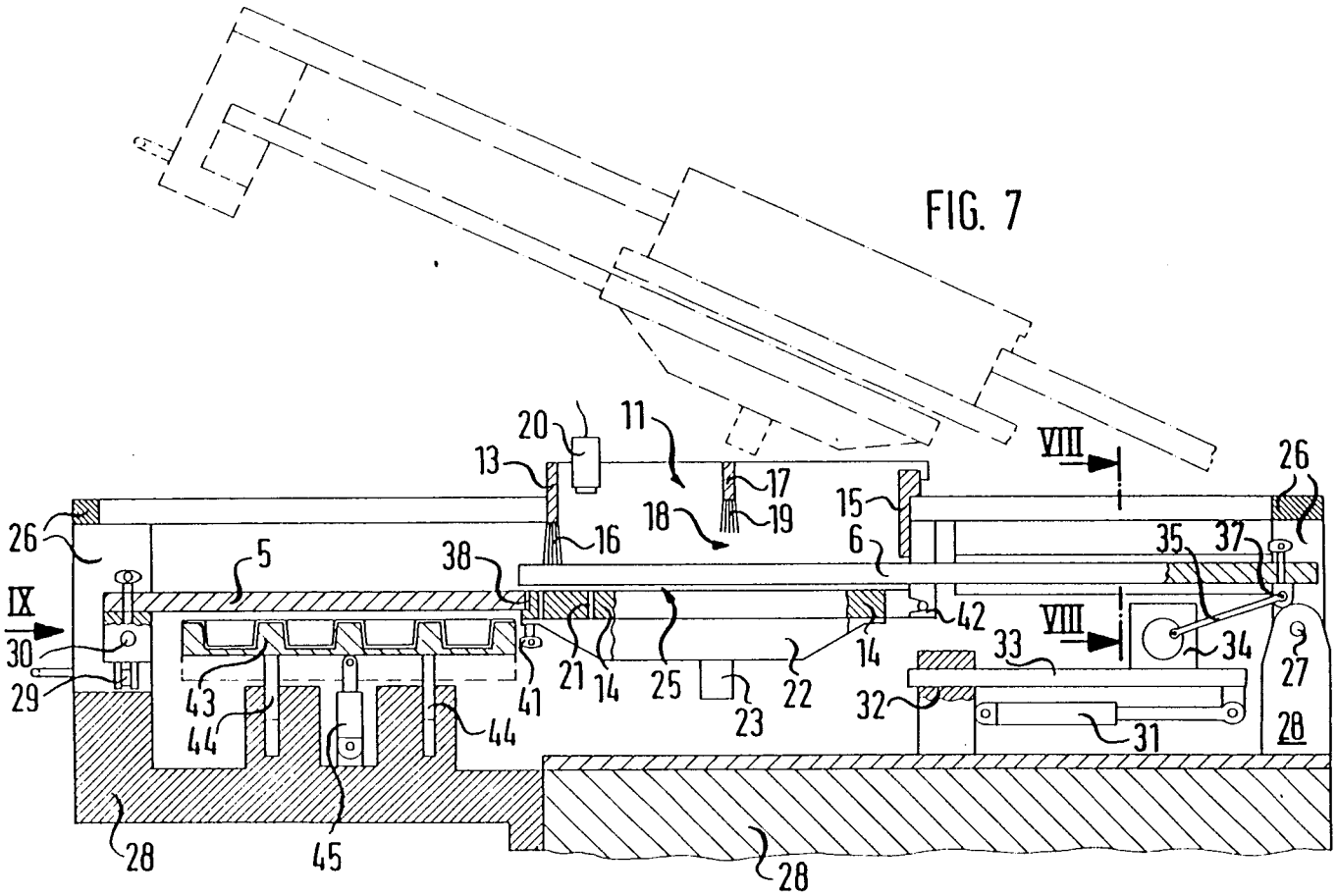
FIG. 7 is a partially side elevational, partially longitudinal cross sectional view of the apparatus according to FIGS. 1 to 6.

The feed slider 6 and the distributing slider 5 are guided in a frame 26 as is apparent from FIGS. 1, 2 and 7 to 9, which is supported on the base member 28 pivotable back and forth on an axis 27 relative to the foil strip 1, wherein in FIG. 7 the swung down position of the frame 26 shown is indicated with solid lines while the swung up position is indicated with dot-dashed lines.

The frame 26 supports the drive 29 for the delivery slider 5 running in a guide 30, further the loading box 11 and the lower base 14 with the suction housing 22.

The drive 31 for the motion of the feed slider 6 operates between the base member 28 and a sliding table 33 guided at 32 on the base member 28 in the motion direction of the feed slider 6, which supports the drive 34 for the pivotal motion of the feed slider 6. This pivoting drive 34 is connected by a connecting rod 35 with the feed slider 6.

The sliders 5,6 are coupled releasably easily with their sliding drives 29, 31 and 34, the distributing slider 5 with the guide shoe 30.1 with 36 and the feed slider 6 with the connecting rod 35. They are usually guided in the guide members or strips 38,39 from which they can be pulled in the guide direction into a state uncoupled from their sliding drive so that the sliders 5,6 can be exchanged or substituted and quickly when products and/or formats are changed.

The exchangable sliders 5,6 differ from each other only in the arrangement and structure of the openings 7 and/or the holes 8 and the feed slider 6 in all case in the plate thickness. Understandably the loading box can be adjusted to shape changes.

It is possible because of that to adjust to the different format width the box wall 40 bounding laterally the loading box 11 held between the skimmer strip 13 and the rear wall 15 slidable transversely in the guides 41 on the rear wall 15 and fixed in their positions in the guide 15 by clamping elements 42.

The rear wall 15 and the lateral box walls 40 are adjustable in regard to their height to the thickness of the feed slider 6. Balancing strips contacted by springs on the top side of the feed slider 6 are provided on the lower edge of these walls 15, 40 for the height adjustment. In the swung up position of the frame 26 the sliders 5,6 and all other components held in the frame 26 are accessible from below while the foil strip 1 is accessible from above so the cleaning work can be performed in a problem free way. In this swung up position of the frame 26 the suction housing 22 is also accessible. To be able to perform also the cleaning work the lower base 14 is connected at 41,42 with the suction housing 22 and with the frame 26 easily and quickly.

Moreover the skimmer strip 13 is held easily exchangable in the frame 26 and the rear retaining strip 17 in the lateral wall 40 of the loading box 11 so that also exchanges of both strips 13,17, product and format changes are easily made. The base member 28 is adjustable in the frame 26 parallel to the foil strip direction (arrow 2) so that both sliders 5,6 with their openings 7 and/or holes 8 can be brought together in coincidence with the cups 4 in the foil strip 1 when the sliders 5,6 are in the delivering position.

Usually the foil strip 1 runs over a lifting table 43 provided under the distributing slider 5 which is guided at 44 in base member 28 and whose drive 45 is controlled depending on the sliding motion so that it raises the foil strip 1—as shown in FIG. 7—toward the distributing slider 5, when the small items are delivered from the openings 7 of the feed slider 6 into the cups 4 of the foil strip 1 and subsequently drop from the distributing slider 5 so that the sliding of the foil strip 1 and the motion of the distributing slider 5 can occur without friction into the closed position.

We claim:

1. In an apparatus for feeding and depositing a small item to be packaged like a tablet, capsule, pill or the like in a packaging machine into a plurality of upwardly open cups in a foil strip to package said small item, especially in a deep drawn foil strip, said apparatus comprising a feed slider and a distributing slider movable substantailly parallel to said foil strip positioned above said foil strip over each other, of which the upper one of said sliders movable transverse to the feed direction of said foil strip is said feed slider and is provided with a plurality of openings each dimensioned for receiving and passing only one of said small items and arranged in a pattern like said cups and of which the lower one of said sliders movable parallel to said feed direction of said foil strip is said distributing slider and is provided with a plurality of holes for the passage of said small items from said openings into said cups, wherein said sliders are slidable into a delivery position in which said openings coincide with said holes and with said cups and at least one of said sliders is slidable into a closed position in which said distributing slider secures said openings in said feed slider underneath against said passage of said small items, the improvement wherein said distributing slider is movable into said closed position and said holes are interrupted in the sliding direction of said distributing slider by a plurality of cross members which are oriented longitudinally in the sliding direction of said feed slider and in said closed postion of said distributing slider are under said openings of said feed slider movable into said delivery position, said feed slider forming the bottom of a loading box filled with said small items in no particular order provided laterally adjacent said foil strip in said motion direction of said foil strip and being movable back from and into said delivery position with all of said openings into said loading box, further said loading box being closed in the direction of said foil strip on the top side of said feed slider for said small items by a skimmer strip and being provided with a lower base under said feed slider which extends under said loading box to said distributing slider and secures said openings of said feed slider from said distributing slider from below against said passage of said small items as well as aligns with said cross members of said distributing slider and forms a sliding path for said small pieces with said openings of said feed slider during motion of said feed slider, said small pieces in said openings on said lower base being substantially completely shut off with said upper side of said feed slider and said feed slider being movable in a quickly alternating fashion, namely vibrating, shaking or the like, in position with said openings inside said loading box for uniform filling of said openings with said small items and said loading box in comparison to said feed motion is of such a size that in said sliding motion none of said openings reach a position under said skimmer strip or a rear wall opposing said skimmer strip.

2. The improvement according to claim 1 wherein said skimmer strip is a brush strip with a plurality of downwardly directed elastically flexible bristles reaching to said upper side of said feed slider.

3. The improvement according to claim 1 wherein a rear retaining strip for said small items extending over the width of said loading box and positioned approximately centrally in said loading box is provided which defines a gap with said upper side of said feed slider of at least the height of said small items on said upper side of said feed slider.

4. The improvement according to claim 3 wherein said rear retaining strip is a brush strip with a plurality of elastic flexible bristles, said bristles reaching downwardly to the top of said gap.

5. The improvement according to claim 4 wherein in the front portion of said loading box adjacent said skimmer strip a sensor controlling the filling state of said small items is provided in said loading box and said filling of said loading box with said small items is controllable with a signal from said sensor.

6. The improvement according to claim 5 wherein said lower base has a plurality of perforations not preventing the sliding of said small items on said lower base and forming a cover for a suction housing connected to a vacuum source and between the underside of said feed slider and the upper side of said lower base a free space smaller than the height of said small items in said openings exists.

7. The improvement according to claim 6 wherein said feed slider and said distributing slider are guided in a frame which is supported pivotable to and from said foil strip and at least partially supports a slider drive and said loading box and said lower base with said suction housing.

8. The improvement according to claim 7 wherein said sliders are easily interchangable in said frame, are releasably coupled with said slider drive and are withdrawable from a plurality of guide members in a guiding direction into an uncoupled state.

9. The improvement according to claim 7 wherein said lower base is attached detachably with said suction housing and said suction housing and said lower base are attached detachably with said frame.

10. The improvement according to claim 7 wherein the walls of said loading box bounding laterally said loading box between said skimmer strip and said rear wall are guidable slidably transverse to said rear wall and said rear wall and said walls of said loading box are adjustable in height to fit the thickness of said feed slider.

11. The improvement according to claim 10 wherein said skimmer strip on said frame and said rear retaining strip on said lateral walls of said loading box are kept easily interchangable.

12. The improvement according to claim 11 wherein said frame is supported and held on said base member which is movable parallel to said base member in said feed direction of said foil strip and is held fixed in position.

13. The improvement according to claim 12 wherein said foil strip runs over a lifting table provided under said distributing strip which raises and lowers said foil strip to and from said distributing slider.

14. An apparatus for feeding and depositing a small item to be packaged like a tablet, a capsule, a pill or the like in a packaging machine into a plurality of upwardly open cups in a foil strip to package said small item comprising:

a frame for said apparatus for support pivotable to and from said foil strip;

a feed slider positioned over said foil strip movable transverse to the feed direction of said foil strip being provided with a plurality of openings each dimensioned for receiving and passing only one of said small items and arranged in a pattern like said cups;

a distributing slider positioned over said foil strip movable parallel to said feed direction of said foil strip but positioned under said feed slider and movable transverse thereto being provided with a plurality of holes for the passage of said small items from said openings into said cups, said feed slider and said distributing slider being guided in said frame, being easily releasably coupled with a slider drive mounted in said frame and being easily interchangable and withdrawable from a plurality of guide members in said frame, said sliders being slidable into a delivery position in which said openings coincide with said holes and with said cups and at least one of said sliders including said distributing slider is slidable into a closed position in which said distributing slider secures said openings in said feed slider underneath against said passage of said small items, said distributing slider having a plurality of cross members oriented longitudinally in said sliding direction of said feed slider interrupting said holes in said sliding direction and in said closed position of said distributing slider said cross members are under said openings of said feed slider;

a loading box provided laterally adjacent said foil strip having a bottom which is a portion of said feed slider and including a skimmer strip closing said loading box in the direction of said foil strip, a lower base provided under said feed slider which extends under said loading box to said delivery slider and secures the openings of said feed slider from said distributing slider from below against said passage of said small items as well as aligns with said cross members of said distributing slider and a rear retaining strip comprising a brush strip with a plurality of elastic flexible bristles for said small items extending over the width of said loading box and positioned approximately centrally in said loading box which defines a gap with said upper side of said feed slider of at least the height of said small items on said upper side of said feed slider, said lower base having a plurality of perforations not preventing the sliding of said small items on said lower base and forming a cover for a suction housing connected to a vacuum source and between the underside of said feed slider and the upper side of said lower base a free space smaller than the height of said small items in said openings exists;

a sensor mounted in the front portion of said loading box adjacent said skimmer strip and controlling the filling state of said small items and said filling of said loading box with said small items is controllable with a signal from said sensor; and a lifting table provided under said distributing strip which raises and lowers said foil strip to and from said distributing slider.

* * * * *